US006625413B2

(12) United States Patent
Oguma et al.

(10) Patent No.: US 6,625,413 B2
(45) Date of Patent: Sep. 23, 2003

(54) DEVELOPING DEVICE, PROCESS CARTRIDGE AND ELECTROPHOTOGRAPHIC IMAGE FORMING APPARATUS

(75) Inventors: Toru Oguma, Shizuoka (JP); Kazushi Watanabe, Shizuoka (JP); Toshiyuki Karakama, Shizuoka (JP); Akiyoshi Yokoi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,213

(22) Filed: Oct. 29, 2001

(65) Prior Publication Data

US 2002/0067930 A1 Jun. 6, 2002

(30) Foreign Application Priority Data

Oct. 31, 2000 (JP) ..... 2000/331927

(51) Int. Cl.[7] ..... G03G 21/16

(52) U.S. Cl. ..... 399/222; 399/111; 399/119; 222/DIG. 1

(58) Field of Search ..... 222/DIG. 1; 399/111, 399/113, 114, 119, 222, 262, 263

(56) References Cited

U.S. PATENT DOCUMENTS

| | | | | |
|---|---|---|---|---|
| 5,500,714 | A | 3/1996 | Yashiro et al. | |
| 5,543,898 | A | 8/1996 | Shishido et al. | |
| 5,585,895 | A | 12/1996 | Yashiro et al. | |
| 5,617,579 | A | 4/1997 | Yashiro et al. | 399/114 |
| 5,689,774 | A | 11/1997 | Shishido et al. | 399/111 |
| 5,774,766 | A | 6/1998 | Karakama et al. | 399/111 |
| 5,966,566 | A | 10/1999 | Odagawa et al. | 399/109 |
| 5,966,568 | A * | 10/1999 | Numagami et al. | 399/111 |
| 6,070,028 | A | 5/2000 | Odagawa et al. | 399/104 |
| 6,097,909 | A | 8/2000 | Watanabe et al. | 399/111 |
| 6,144,398 | A | 11/2000 | Yokoyama et al. | 347/263 |
| 6,163,665 | A | 12/2000 | Watanabe et al. | 399/111 |
| 6,246,849 | B1 | 6/2001 | Yokoyama et al. | 399/117 |
| 6,266,500 | B1 | 7/2001 | Numagami et al. | 399/104 |
| 6,272,299 | B1 | 8/2001 | Numagami et al. | 399/111 |

* cited by examiner

*Primary Examiner*—Hoang Ngo
(74) *Attorney, Agent, or Firm*—Fitzpatrick, Cella, Harper & Scinto

(57) ABSTRACT

A developing device is detachably mountable to the main body of an electrophotographic image forming apparatus. The device is for developing an electrostatic latent image on an electrophotographic photosensitive member and includes a developing member for developing the electrostatic latent image formed on the electrophotographic photosensitive member, a developer container containing therein a developer to be used to effect the development of the electrostatic latent image by the developing member, a developing frame for supporting the developing member, a welding rib provided along the lengthwise direction of the developing frame to connect the developer container and the developing frame together by-ultrasonic welding, and a plurality of reinforcing members provided on the back of that surface of the developing frame on which the welding rib is provided, along the lengthwise direction of the welding rib, to increase the strength of the developing frame. The welding rib provided on the developing frame is disposed so as to be located between the plurality of reinforcing members as viewed from a direction intersecting with the surface and the back, and the developer container and the developing frame are connected together by the ultrasonic welding.

18 Claims, 14 Drawing Sheets

DEVELOPING DEVICE, PROCESS CARTRIDGE AND ELECTROPHOTOGRAPHIC IMAGE FORMING APPARATUS

BACKGROUND OF THE INVENTION

1. Field of the Invention

The invention relates to an electrophotographic image forming apparatus, and a developing device and a process cartridge for use therein.

The electrophotographic image forming apparatus forms an image on a recording medium by the use of the electrophotographic image forming process. Examples of the electrophotographic image forming apparatus include an electrophotographic copier, an electrophotographic printer (such as a laser beam printer or an LED printer), a facsimile apparatus and a word processor.

Also, the process cartridge may be a cartridge into which charging means, developing means or cleaning means and an electrophotographic photosensitive drum are integrally incorporated, and which is made detachably mountable to the main body of the electrophotographic image forming apparatus. Alternatively, the process cartridge may be a cartridge into which at least one of charging means, developing means and cleaning means and an electrophotographic photosensitive drum are integrally incorporated, and which is made detachably mountable to the main body of the electrophotographic image forming apparatus. Further alternatively, the process cartridge may be a cartridge into which at least developing means and an electrophotographic photosensitive drum are integrally incorporated, and which is made detachably mountable to the main body of the electrophotographic image forming apparatus.

2. Description of the Related Art

In an electrophotographic image forming apparatus using the electrophotographic image forming process, there is adopted a process cartridge system in which an electrophotographic photosensitive member and process means for acting on the electrophotographic photosensitive member are integrally made into a cartridge which is made detachably mountable to the main body of the electrophotographic image forming apparatus. According to the process cartridge system, the maintenance of the apparatus can be done by a user himself without resorting a serviceman and therefore, the operability of the apparatus can be markedly improved. Therefore, the process cartridge system is widely used in electrophotographic image forming apparatuses.

As an example of such a process cartridge, there is known a developing device in which developing means which is one of the aforementioned process means is integrally made into a cartridge. The developing device sometimes adopts a construction in which a developing frame for supporting a developing sleeve or the like and a developer container for containing therein a toner which is a developer have their respective joint portions abutting against each other and ultrasonically welded together.

FIGS. 2, 3 and 4 of the accompanying drawings show an example of a conventional developing device. FIG. 2 is a longitudinal cross-sectional view showing the developing device as it is divided into a developing frame 52 and a developer container 51. FIG. 3 is a view of the developing frame 52 as it is seen from the developer container 51 side (from the direction of arrow III in FIG. 2), and FIG. 4 is a view of the developer container 51 as it is seen from the developing frame 52 side (from the direction of arrow IV in FIG. 2).

As shown in FIG. 4, the joint portion of the developer container 51 to the developing frame 52 is provided with an opening portion 51*a* for feeding the toner from the developer container 51 to the developing frame 52 therethrough. The opening portion 51*a*, as shown in FIG. 4, is of a rectangular shape long in the left to right direction when the developer container 51 is seen from the developing frame 52 side. The opening portion 51*a* is provided with a toner seal member 53 having the surroundings of the opening portion 51*a* welded thereto so as to cover the opening portion 51*a*. The toner seal member 53 is torn before the use of the developing device and becomes capable of feeding the toner from the developer container 51 into the developing frame 52.

On the other hand, as shown in FIG. 3, the developing frame 52 is provided with an opening portion 52*a* for supplying the toner fed out from the developer container 51 to a developing sleeve therethrough. The opening portion 52*a* is provided in opposed relationship with the opening portion 51*a* of the developer container 51, and is substantially equal in size to the opening portion 51*a* of the developer container 51.

As shown in FIG. 3, welding ribs 52*b* and 52*c* ultrasonically welded to the developer container 51 are provided in the respective vicinities of the upper and lower end portions of the developing frame 52. The two welding ribs 52*b* and 52*c* are straight and are disposed substantially parallel to each other along the lengthwise direction of the opening portion 52*a*. Convex bosses 52*d* and 52*e* for positioning the developing frame 52 relative to the developer container 51 are provided on the lengthwisely opposite end portions of the upper welded rib 52*b*. Also, in order to prevent the leakage of the toner from between the developing frame 52 and the developer container 51, seal members 55 and 56 formed of elastomeric foam are attached to the lengthwisely opposite end portions of the developing frame 52.

On the other hand, as shown in FIG. 4, the developer container 51 is formed with welding grooves 51*b* and 51*c* at locations opposed to the welded ribs 52*b* and 52*c* of the developing frame 52. The two welding grooves 51*b* and 51*c* are straight, and are disposed substantially parallel to each other along the lengthwise direction of the opening portion 51*a*. Positioning holes 51*d* and 51*e* fitted onto the bosses 52*d* and 52*e*, respectively, provided on the developing frame 52 are formed in the lengthwisely opposite end portions of the upper welding groove 51*b*.

The developing frame 52 and the developer container 51 are positioned relative to each other by the bosses 52*d*, 52*e* and the positioning holes 51*d*, 51*e* being fitted together, and thereafter as shown in FIG. 2, ultrasonic vibration is applied thereto while the backs 52*f* and 52*g* of the surfaces on which the welding ribs 52*b* and 52*c* of the developing frame 52 are provided and the backs of the surfaces in which the welding grooves 51*b* and 51*c* of the developer container 51 are provided are pressed, whereby the welding ribs 52*b* and 52*c* are melted and welded to the welding grooves 51*b* and 51*c*, respectively, of the developer container 51.

In the above-described conventional construction, however, if the welding condition is too strong during ultrasonic welding, the unevenness of the melting of the welding ribs increases and therefore, the developing frame becomes liable to be deformed. This has led to the possibility that the positional accuracy of parts attached to the developing frame may be reduced or the positional accuracy of the developing device and the image forming apparatus may be reduced, whereby the quality of printing may be reduced. Also, by making the energy applied during ultrasonic welding small in order to avoid such possibility, there have been posed the problem that the strength of welding is reduced or the setting of the welding condition becomes difficult, and the problem that the cost for raising the accuracy of parts is increased.

SUMMARY OF THE INVENTION

It is an object of the present invention to provide a developing device, a process cartridge and an electrophotographic image forming apparatus provided with a frame structure having sufficient welding strength.

It is another object of the present invention to provide a developing device, a process cartridge and an electrophotographic image forming apparatus provided with a construction suffering little from frame deformation during ultrasonic welding.

It is another object of the present invention to provide a developing device, a process cartridge and an electrophotographic image forming apparatus provided with a construction which is high in the positional accuracy of developing means supported by a developing frame.

It is another object of the present invention to provide a developing device, a process cartridge and an electrophotographic image forming apparatus provided with a construction having a welding rib with which a developing container and developing frame are connected together by ultrasonic welding, the welding rib being provided on a joined surface opposite from a surface on which a plurality of reinforcing members are provided, and the plurality of reinforcing members provided along a lengthwise direction of the developing frame with spacing between them in a direction intersecting the lengthwise direction to increase the strength of the developing frame, the welding rib being provided between the plurality of reinforcing members.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

A developing device and a process cartridge according to some embodiments of the present invention and an electrophotographic image forming apparatus (hereinafter referred to as the image forming apparatus A) using the same will hereinafter be described. In the following description, the lengthwise direction is a direction intersecting with (substantially orthogonal to) a direction in which the process cartridge B is mounted to and dismounted from the main body of the image forming apparatus A, and parallel to the surface of a recording medium and intersecting with (substantially orthogonal to) the conveying direction of the recording medium.

Embodiment 1

[Explanation of the Overall Construction of the Image Forming Apparatus]

Figure 13:
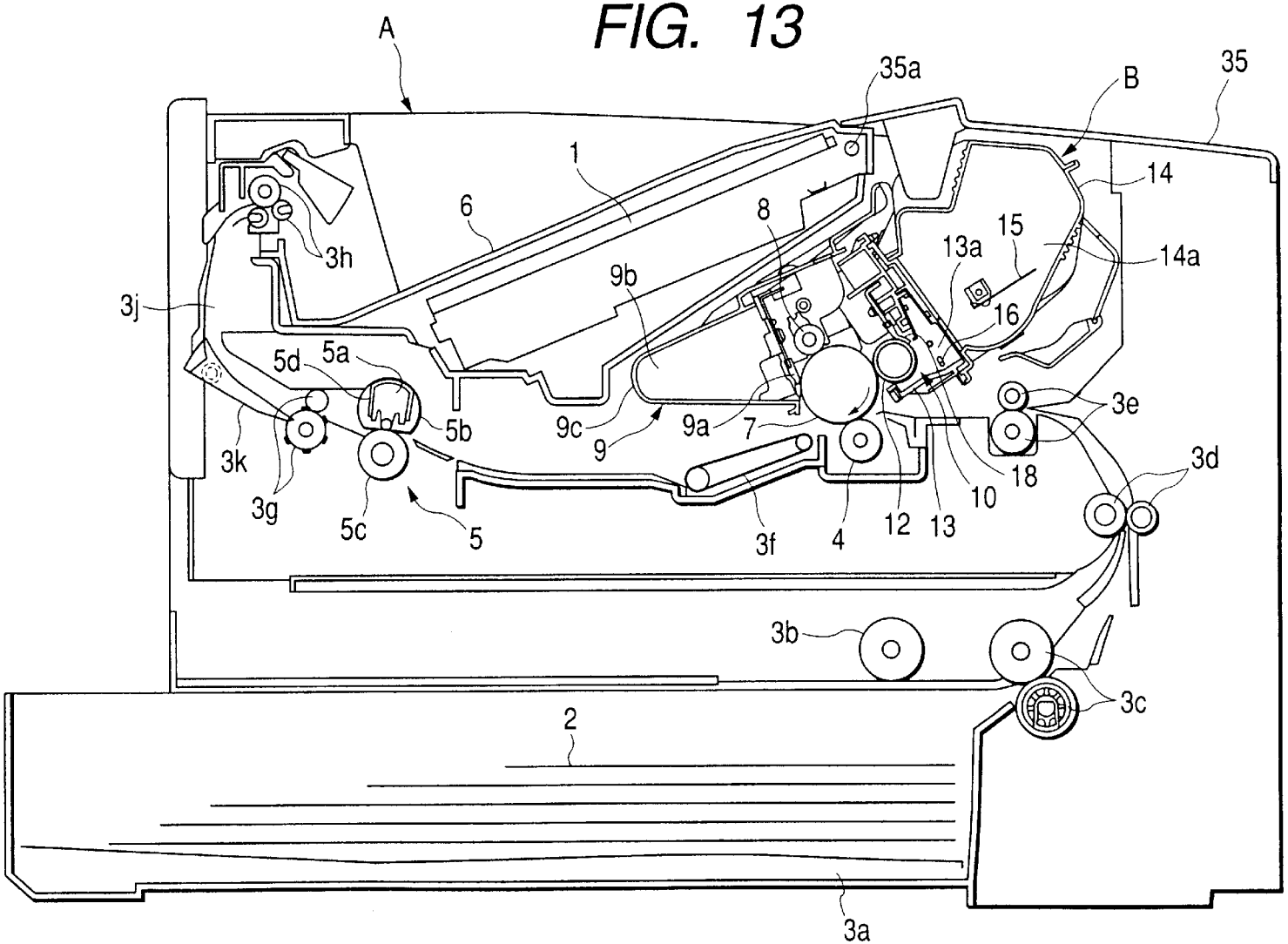
FIG. 13 is a longitudinal cross-sectional view schematically showing the general construction of the main body of an electrophotographic image forming apparatus with a process cartridge mounted thereto.

The overall construction of the image forming apparatus A will first be described with reference to FIG. 13. FIG. 13 is a schematic view showing the longitudinal cross-section of the image forming apparatus A with the process cartridge B mounted thereto. The process cartridge B is shown in FIG. 1.

A drum-shaped electrophotographic photosensitive member (hereinafter referred to as the photosensitive drum 7) which is a form of an image bearing member is provided in the process cartridge B in the image forming apparatus A. The photosensitive drum 7 is rotated in the direction of arrow in FIG. 13, and is charged by a charging roller 8 which is charging means. Then, a laser beam modulated according to image information is applied from optical means 1 having a laser diode, a polygon mirror, a lens and a reflecting mirror to the photosensitive drum 7, whereby a latent image conforming to the image information is formed on the photosensitive drum 7. The latent image is developed by developing means 10 and is made into a toner image which is a visible image.

Figure 1:
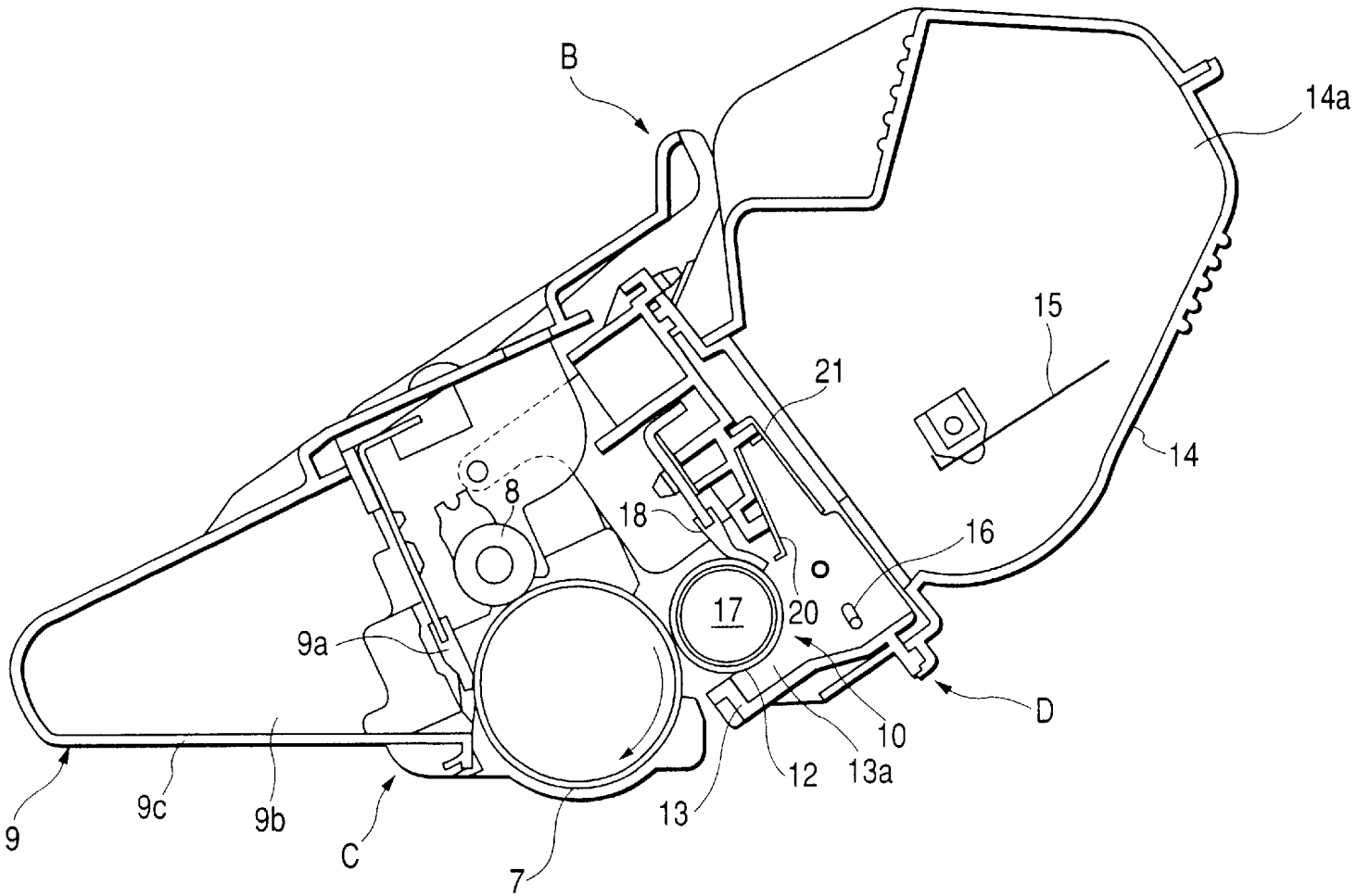
FIG. 1 is a longitudinal cross-sectional view of the process cartridge of the present invention.
Figure 2:
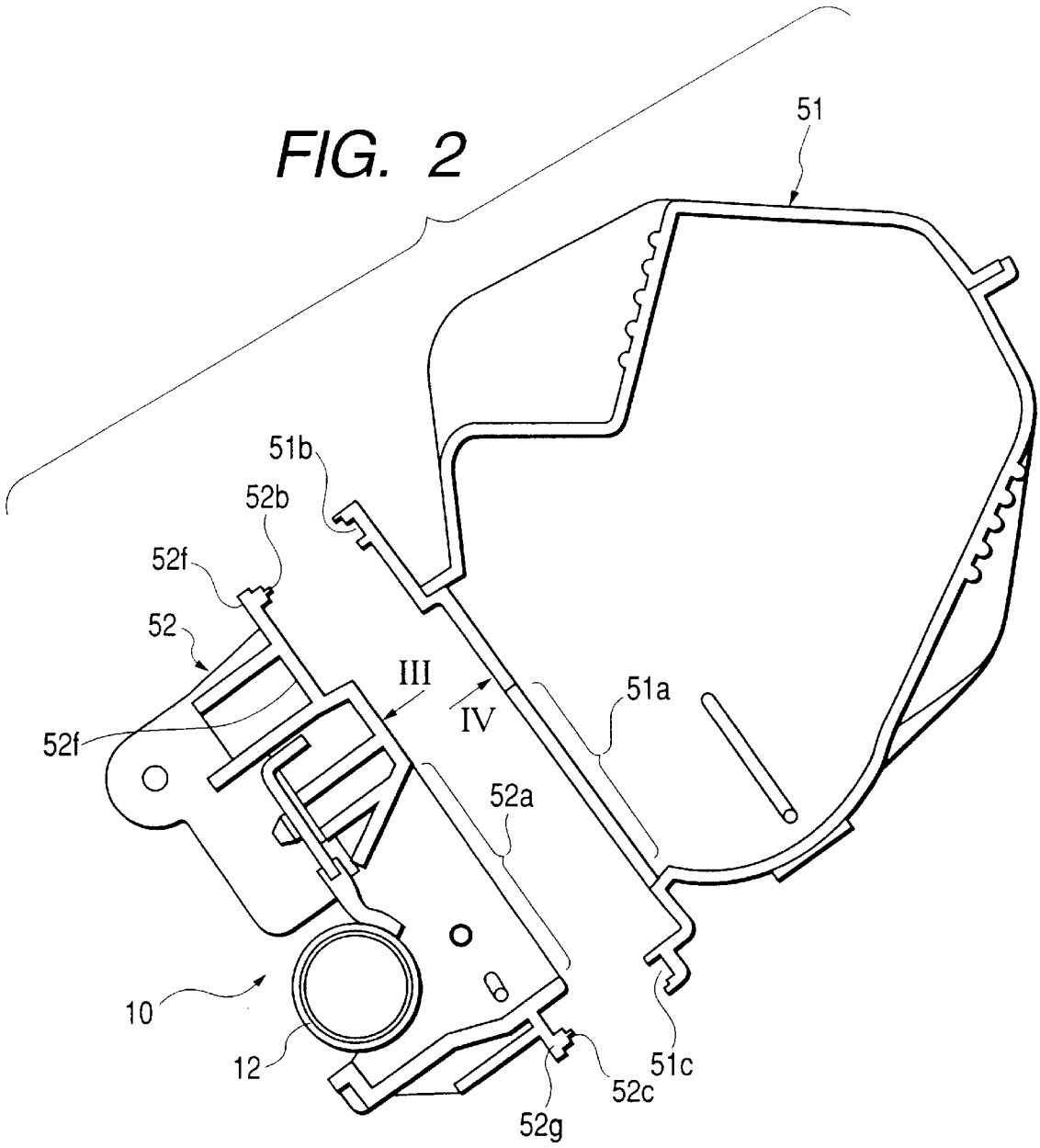
FIG. 2 is a longitudinal cross-sectional view showing a conventional developing device as it is separated into a developer container and a developing frame and is seen from a side thereof.
Figure 3:
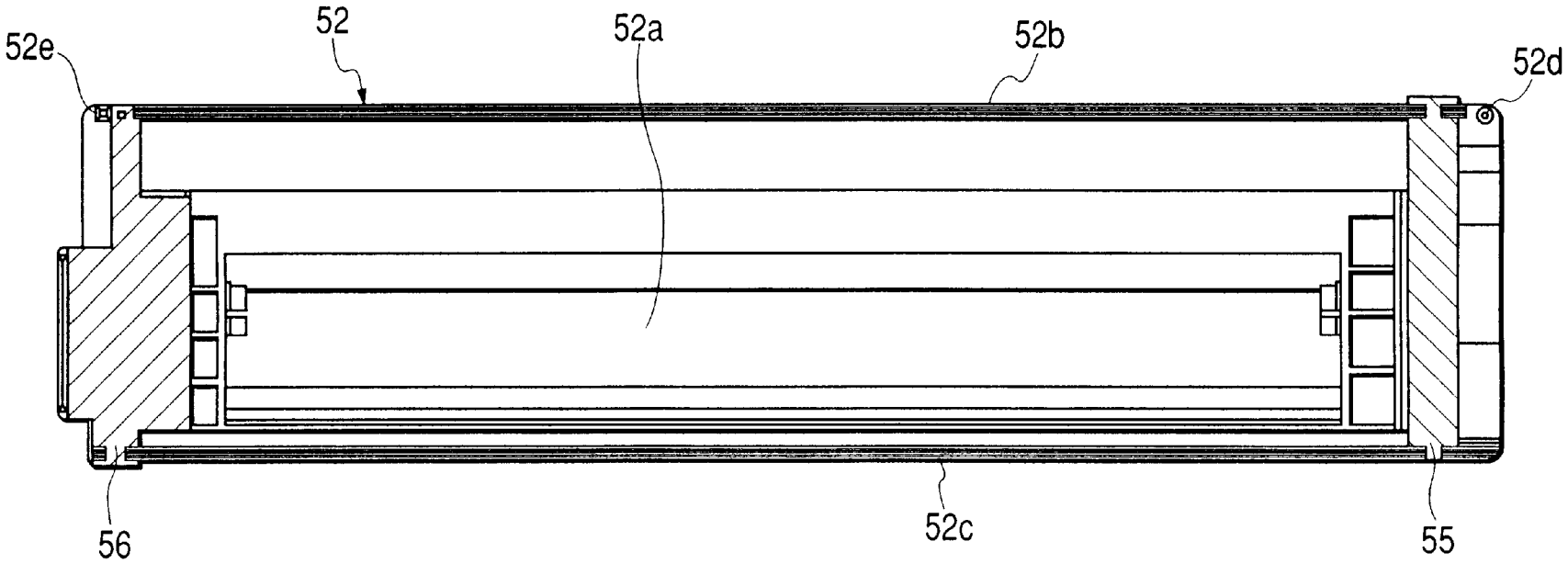
FIG. 3 is a front view of the conventional developing frame as it is seen from the developer container side.
Figure 4:
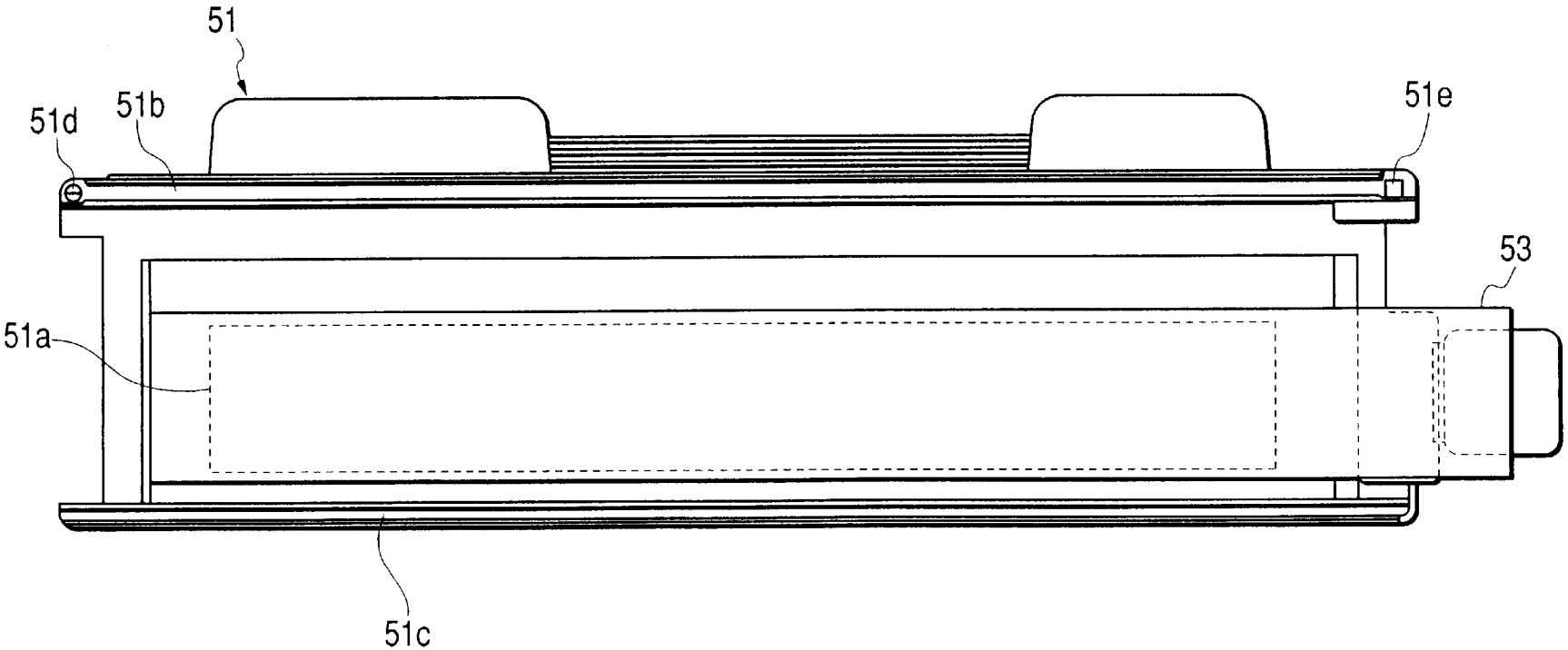
FIG. 4 is a front view of the conventional developer container as it is seen from the developing frame side.

As shown in FIG. 1, the developing means 10 comprises a developing sleeve 12 which is a developer bearing member for feeding a developer (toner) to the photosensitive drum 7, and a developing blade 18 which is a regulating member for regulating the amount of toner adhering to the surface of the developing sleeve 12. Also, the developing sleeve 12 and the developing blade 18, and a developing frame 13 holding them, and a developer container 14 (referred to also as the toner container) containing the toner (developer) therein are coupled together to thereby constitute a developing unit D which is a developing device.

As shown in FIG. 1, the developing sleeve 12 has a substantially cylindrical outer surface and is rotatably supported on the developing frame 13, and contains a stationary magnet 17 therein. Also, the developing blade 18 is such that an elastic blade at its distal end is disposed substantially parallel to the developing sleeve 12 at a suitable interval from the developing sleeve 12. The developer container 14 forms a toner containing portion 14*a* containing therein the toner which is the developer, and is provided with a toner feeding member 15 for feeding out the toner in the toner containing portion 14*a*. The toner feeding member 15 has a plastic sheet having flexibility and elasticity. The developer container 14 is secured to the developing frame 13 and supplies the toner in the toner containing portion 14*a* to the developing frame 13.

The developing frame 13 has a developing chamber 13*a*, and the toner in the toner containing portion 14*a* adjacent to the developing chamber 13*a* is fed into the developing chamber 13*a* by the rotation of the toner feeding member 15. The developing frame 13 is provided with a rotatable toner agitating member 16 in the vicinity of the developing sleeve 12, and circulates the toner in the developing chamber 13*a* fed out from the toner containing portion 14*a*, by the rotation of the toner agitating member 16. Also, the toner has magnetism and the developing sleeve 12 contains the stationary magnet 17 therein and therefore, the toner adheres onto the developing sleeve 12.

The toner is carried by the developing sleeve 12 being rotated, and triboelectrification charges are induced in the toner by the developing blade 18 and a toner layer of a predetermined thickness is formed on the developing sleeve 12, and the toner is carried to the developing area of the photosensitive drum 7. The toner supplied to the developing area is shifted to the latent image on the photosensitive drum 7 to thereby form a toner image on the photosensitive drum 7. The developing sleeve 12 is connected to a developing bias circuit provided in the main body of the image forming apparatus A, and usually a developing bias voltage comprising an AC voltage and a DC voltage superimposed thereupon is applied to the developing sleeve.

On the other hand, in synchronism with the formation of the toner image, a recording medium 2 set in a feed cassette 3*a* as shown in FIG. 13 is transported to a transfer position by a pickup roller 3*b*, a pair of transporting rollers 3*c* and 3*d* and a pair of registration rollers 3*e*. A transfer roller 4 as transfer means is disposed at the transfer position, and a voltage is applied to the transfer roller 4 to thereby transfer the toner image on the photosensitive drum 7 to the recording medium 2.

The recording medium 2 to which the toner image has been transferred is transported to fixing means 5 by a transportation guide 3*f*. The fixing means 5 is provided with a driving roller 5*c* and a fixing rotary member 5*b* of a cylindrical sheet containing a heater 5*a* therein and supported by a supporting member 5*d*, and applies heat and pressure to the passing recording medium 2 to thereby fix the transferred toner image on the recording medium 2.

The recording medium 2 on which the toner image has been fixed is transported by a pair of delivery rollers 3*g* and is delivered to a delivery tray 6 by a pair of delivery rollers 3*h* via a surface reverse path 3*j*. The delivery tray 6 is provided on the upper surface of the image forming apparatus A. It is also possible to operate a swingable flapper 3*k* to thereby deliver the recording medium 2 without the intermediary of the surface reverse path 3*j*. In the present embodiment, the pickup roller 3*b*, the pair of transporting rollers 3*c*, 3*d*, the pair of registration rollers 3*e*, the transportation guide 3*f* and the pairs of delivery rollers 3*g*, 3*h* together constitute transporting means.

Also, the photosensitive drum 7 after the toner image has been transferred to the recording medium 2 by the transfer roller 4 has any toner residual thereon removed by cleaning means 9, and thereafter is used for the next image forming process. The cleaning means 9 comprises an elastic cleaning blade 9*a* provided in abutting relationship with the photosensitive drum 7, and a removed toner reservoir 9*b* for containing the residual toner therein. The removed toner reservoir 9*b* is formed by a cleaning frame 9*c*, which in turn supports the cleaning blade 9*a*. The cleaning means 9 scrapes off the residual toner on the photosensitive drum 7 by the cleaning blade 9*a* and collects it into the removed toner reservoir 9*b*.

[Explanation of the Process Cartridge]

As shown in FIG. 1, in the present embodiment, the process cartridge B integrally forms a developing unit D (developing device) with the developer container 14 welded to the developing frame 13 provided with the developing sleeve 12.

Also, the cleaning means 9 such as the cleaning blade 9*a*, the photosensitive drum 7 and the charging roller 8 are supported by a cleaning frame 9*c* to thereby form a cleaning unit C.

The process cartridge B comprises the developing unit D and the cleaning unit C pivotally coupled together and made integral with each other to thereby provide a cartridge.

In the present embodiment, the process cartridge B is provided with toner amount detecting means for successively detecting the remaining amount of toner in. accordance with the consumption of the toner in the developing chamber 13*a*. As shown in FIG. 1, as a measuring electrode member constituting the toner amount detecting means, a first electrode 20 and a second electrode 21 are provided in the developing frame 13, and are disposed substantially parallel to each other along the developing sleeve 12. The first. electrode 20 is provided in the vicinity of and along the developing sleeve 12, and the second electrode 21 is provided more toward the developer container 14 than the first electrode 20, and is disposed in the upper portion of the developing frame 13 so as to be opposed to the first electrode 20. That is, the first electrode 20 and the second electrode 21 are disposed at such locations that they contact with the toner in the developing frame 13 and moreover the areas of contact thereof with the toner fluctuate as the toner is decreased.

The toner amount detecting means causes capacitance to exist between the two electrodes by a voltage being applied to one of the first electrode 20 and the second electrode 21, and is designed to detect the toner amount by measuring the capacitance by a detecting circuit provided in the image forming apparatus A. That is, the toner comes into between the electrodes, whereby the capacitance between the electrodes is changed and therefore, by detecting the change, the toner amount can be detected. In the present embodiment, the voltage is applied to the second electrode 21, which is thus used as the input side, and the first electrode 20 is used as the output side.

The first electrode 20 and the second electrode 21 are disposed at such locations into which the toner carried from the developer container 14 by the toner feeding member 15 can come, and when the toner amount in the process cartridge B is great, the toner is pushed into the space surrounded by the electrodes by the toner feeding member 15 and therefore, the capacitance between the electrodes continues to exhibit a high value. However, as the process cartridge is used, the toner is consumed and the height of the toner between the second electrode 21 and the first electrode 20 is decreased, and the capacitance between the electrodes is also decreased. From the decrease in the capacitance, the toner amount is successively detected.

Finally, the toner in the vicinity of the distal end of the developing blade 18 for scraping off the toner on the surface of the developing sleeve 12 is consumed, whereby a blank area occurs to an image and a no-toner state is brought about. In the present embodiment, a developing bias voltage applied to the developing sleeve 12 is an input voltage, and the capacitance between the developing sleeve 12 and the first electrode 20 is also detected to thereby detect the no-toner state. That is, the toner amount detecting means is designed to be capable of detecting any change in the capacitance between a plurality of electrodes to thereby successively detect the toner amount.

Figure 14:
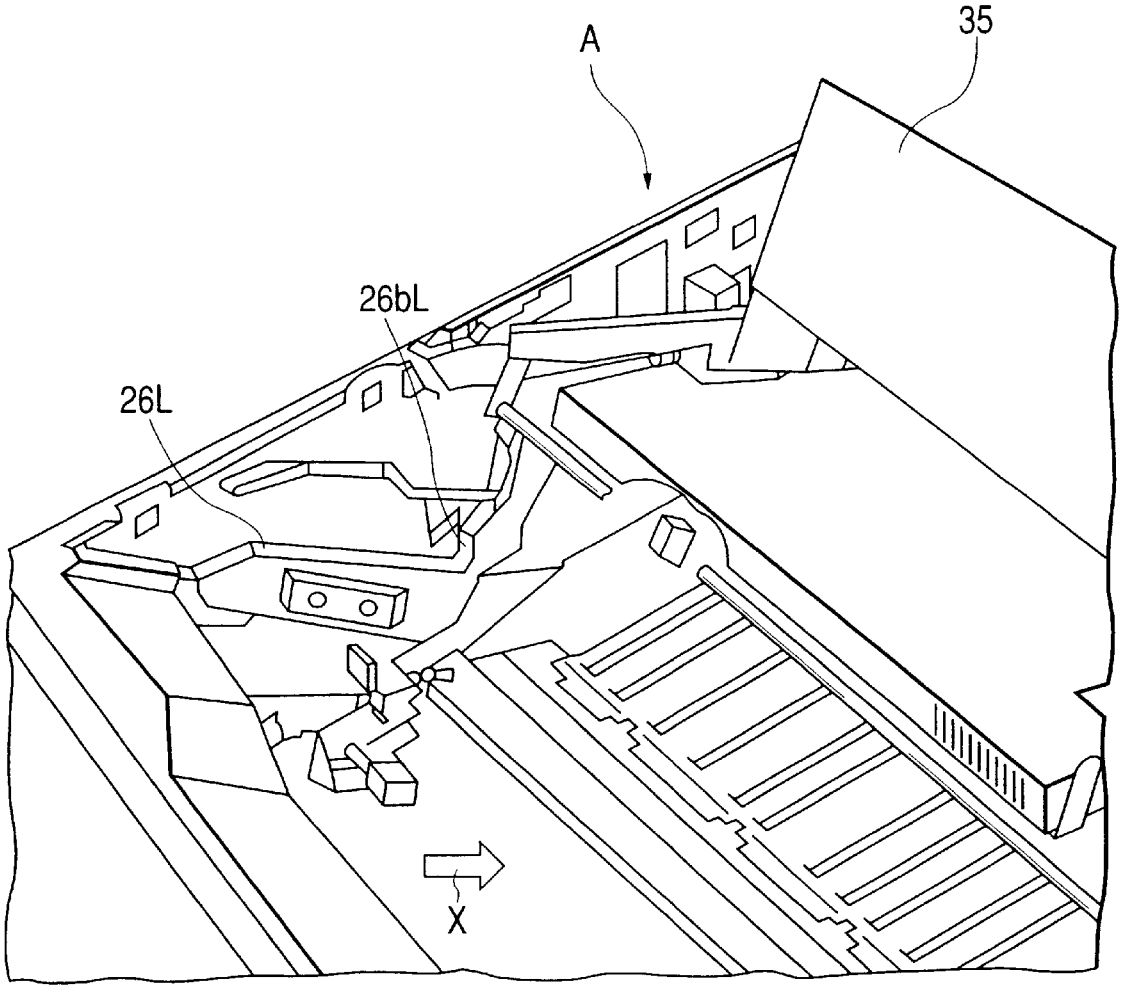
FIG. 14 is a perspective view showing a state in which the opening-closing member of the electrophotographic image forming apparatus is opened.

A method of mounting and dismounting the process cartridge 13 to and from the main body of the image forming apparatus A will now be described with reference to FIG. 14. FIG. 14 is a perspective view showing a state in which the opening-closing member 35 of the image forming apparatus A is opened. When the opening-closing member 35 is opened about a hinge 35*a* shown in FIG. 13, forwardly depending left and right guide rails 26L and 26R (26R being not shown) are seen on the left and right inner walls of the image forming apparatus A. Left and right cylindrical guides, not shown, coaxial with the photosensitive drum 7, and an elongate posture determining guide, not shown, located rearwardly of the cylindrical guides when the direction in which the process cartridge B is mounted to the main body of the image forming apparatus A is forward are inserted along the guide rails 26L and 26R, and the cylindrical guides are fitted into the positioning grooves 26*b*L and 26*b*R (26*b*R being not shown) of the image forming apparatus. A, whereby the process cartridge B is mounted to the image forming apparatus A.

Conversely, when the process cartridge B mounted to the image forming apparatus A is to be detached, the process cartridge B can be pulled out along the guide rails 26L and 26R by a procedure opposite to what has been described above.

[Explanation of the Welding of the Developing Frame and the Developer Container]

Figure 5:
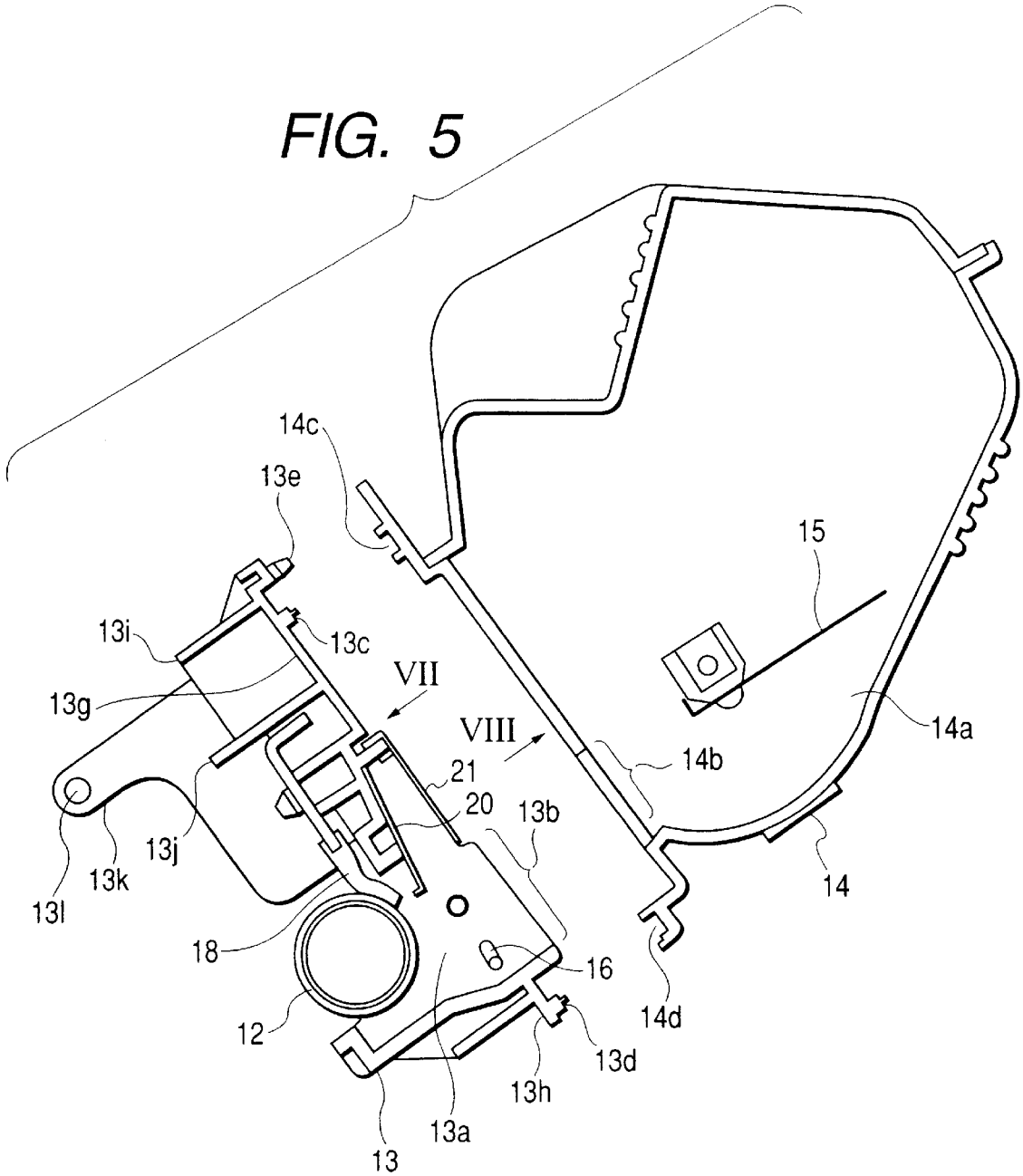
FIG. 5 is a longitudinal cross-sectional view showing a developing device in a first embodiment of the present invention as it is separated into a developer container and a developing frame and is seen from a side thereof.
Figure 6:
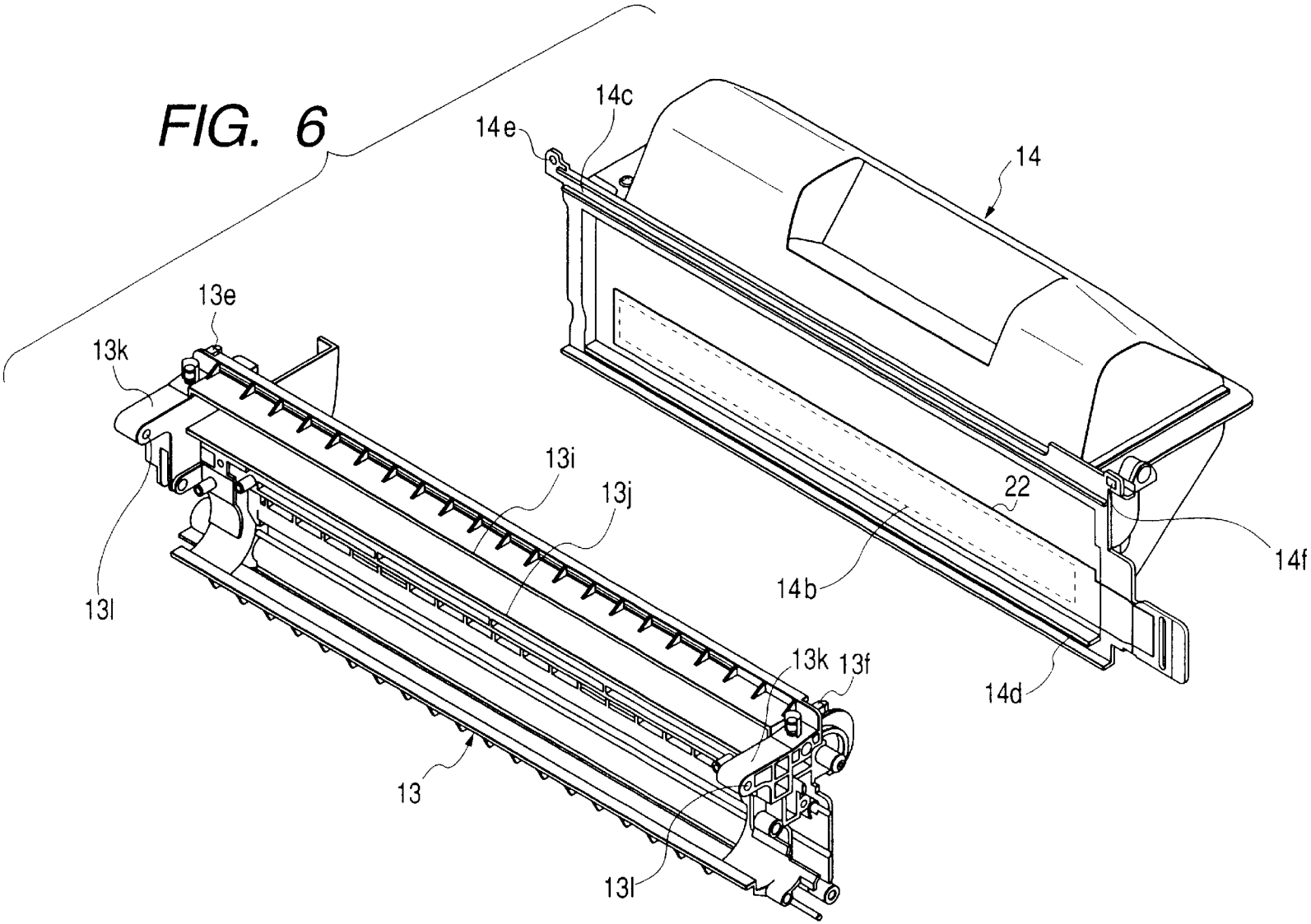
FIG. 6 is a perspective view showing the developing device in the first embodiment of the present invention as it is separated into the developer container and the developing frame.
Figure 7:
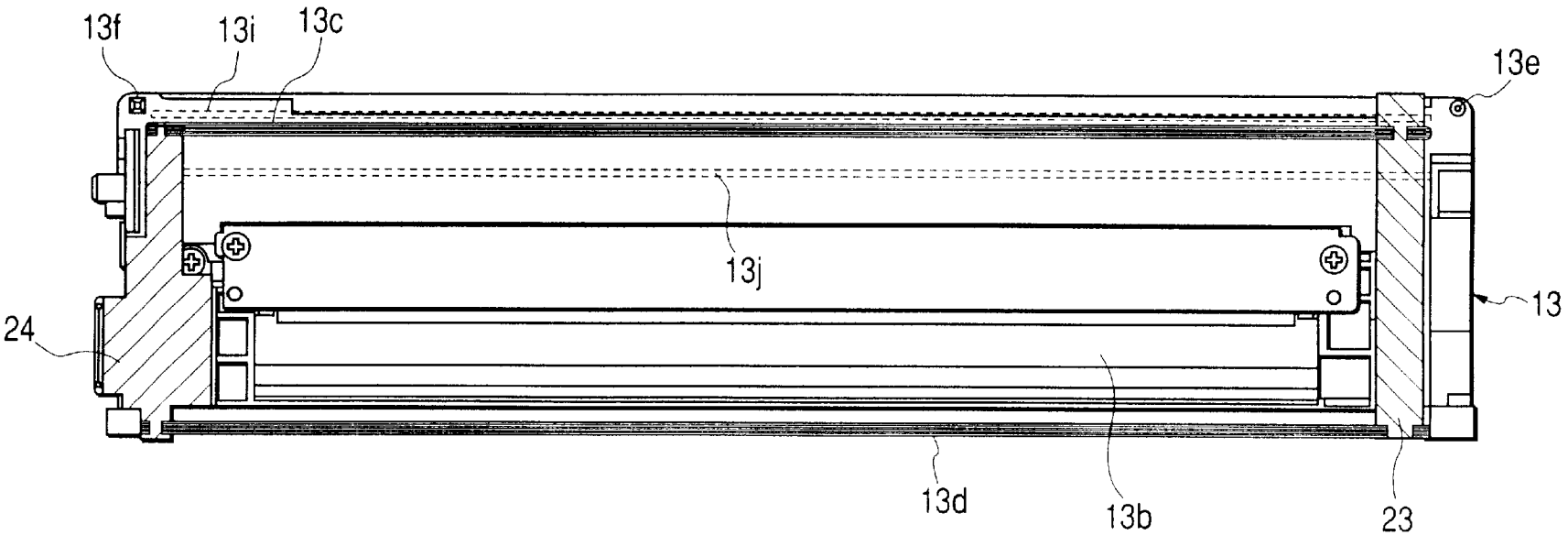
FIG. 7 is a front view showing the developing frame in the first embodiment of the present invention as it is seen from the developer container side.
Figure 8:
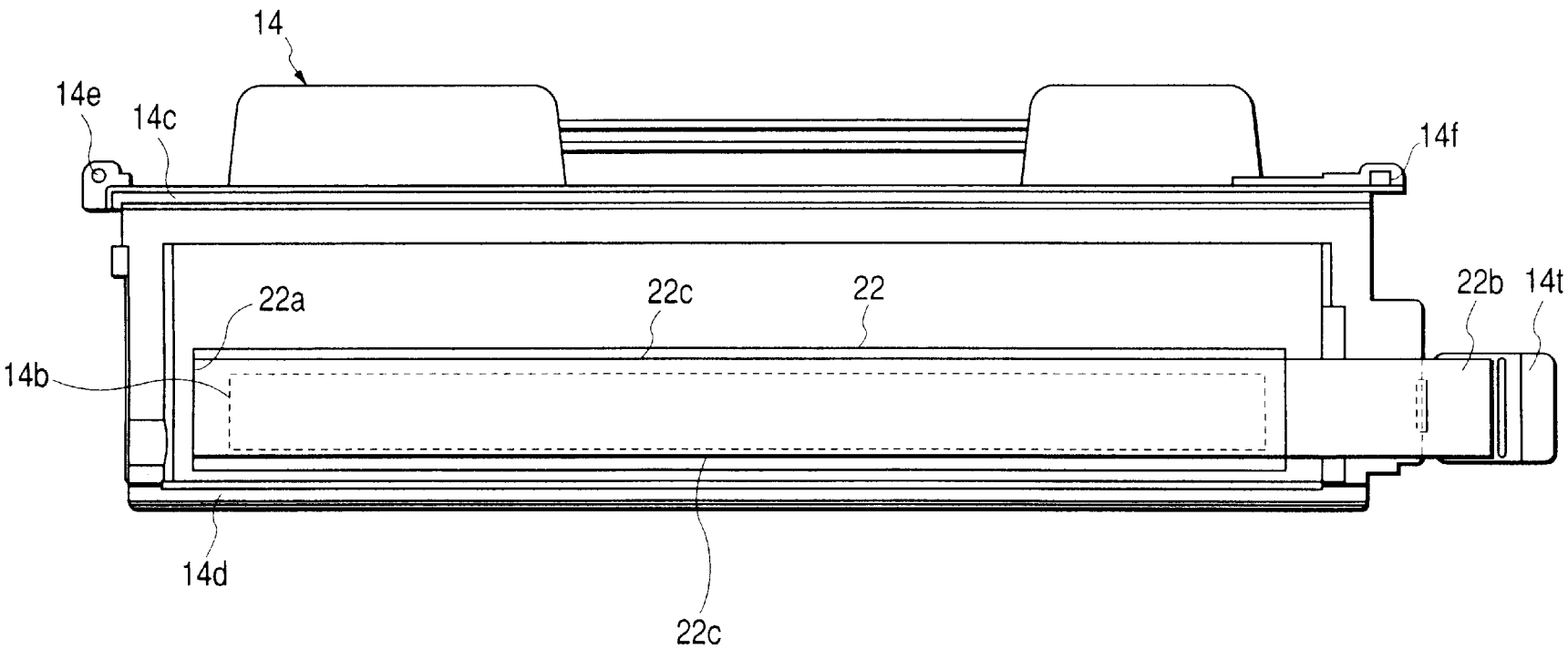
FIG. 8 is a front view showing the developer container in the first embodiment of the present invention as it is seen from the developing frame side.

A coupling construction for the developing frame 13 and the developer container 14 will now be described with reference to FIGS. 5, 6, 7 and 8. FIGS. 5, 6, 7 and 8 show the developing device in the first embodiment of the present invention. FIG. 5 is a longitudinal cross-sectional view showing the state before the developing frame 13 and the developer container 14 are welded together. FIG. 6 is an exploded perspective view of the developing device. FIG. 7 is a view of the developing frame 13 as it is seen from the developer container 14 side (from the direction of arrow VII in FIG. 5), and FIG. 8 is a view of the developer container 14 as it is seen from the developing frame 13 side (from the direction of arrow VIII in FIG. 5).

As shown in FIG. 8, the joined portion of the developer container 14 with the developing frame 13 is provided with an opening portion 14*b* for feeding the toner from the developer container 14 to the developing frame 13. The opening portion 14*b*, as shown in FIG. 8, is of a rectangular shape long in the lengthwise direction (the left to right direction in FIG. 8) when the developer container 14 is seen from the developing frame 13 side. A toner seal member 22 is provided on the opening portion 14*b*.

The toner seal member 22 comprises, for example, PET (polyethylene terephthalate) film laminated on the upper and lower surfaces of Al (aluminum) film, and when new, it is stuck so as to close the opening portion 14*b* of the developer container 14, and seals the toner in the developer container 14. The toner seal member 22 is welded and fixed to the developer container 14 so as to cover and surround the opening portion 14*b* provided in the developer container 14. The toner seal member 22 has a length a little over twice as great as that of the opening portion 14*b*, and is turned back at lengthwise one end portion 22*a* thereof so that the grip end portion 22*b* thereof may extend out of the end of the opening portion 14*b*. The grip end portion 22*b* which is one end of the toner seal member 22 is stuck on a grip member 14*t* which provides a handle. Also, the grip member 14*t* is molded integrally with the developer container 14, and is formed so that the portion thereof connected to the developer container 14 may be made particularly thin and can be cut off. The grip member 14*t* is bent by about 90° and packed up so that the lengthwise space can be saved when the process cartridge B is packed up.

As shown in FIG. 8, the toner seal member 22 has an incision 22*c* formed in a layer of the laminated PET film in order to tear and unseal the opening portion 14*b*, and by performing the unsealing operation, the toner seal member 22 is torn along the incision 22*c* and the opening portion 14*b* of the developer container 14 is unsealed.

To feed the toner contained in the developer container 14 into the developing frame 13, the proximal end of the grip member 14*t* on which the grip end portion of the toner seal member 22 protruding outwardly of the process cartridge B is stuck is first separated from the developer container 14. By the operator pulling the grip member 14*t* after it is separated by his hand, the toner seal member 22 is torn along the incision 22*c* with the turned-back portion as a fulcrum, and the opening portion 14*b* side of the developer container 14 is unsealed and the toner becomes capable of being fed from the developer container 14 into the developing frame 13.

As shown in FIG. 7, the developing frame 13 is provided with an opening portion 13*b* which is a toner receiving port to supply the toner fed out of the developer container 14 to the developing sleeve 12. The opening portion 13*b* is provided at a location opposed to the opening portion 14*b* of the developer container 14, and is substantially equal in size to the opening portion 14*b* of the developer container 14.

As shown in FIG. 7, in the respective vicinities of the upper and lower end portions of the developing frame 13, two welding ribs 13*c* and 13*d* form long straight lines along the lengthwise direction of the opening portion 13*b* and are disposed parallel to each other. The welding ribs 13*c* and 13*d* provide fusing portions during ultrasonic welding, and the longitudinal cross-sectional shape thereof forms the shape of a triangular projection formed while protruding from the vertex surface of a square convex portion (see FIG. 5).

Also, as shown in FIG. 7, on the lenghtwisely opposite end portions of the welding rib 13*c* disposed on the upper side, bosses 13*e* and 13*f* for effecting the positioning relative to the developer container 14 are provided integrally with the developing frame 13. Also, seal members 23 and 24 formed of elastomeric foam are attached to the lengthwisely opposite end portions of the developing frame 13 in order to prevent the leakage of the toner from the joined portion thereof with the developer container 14.

The developing frame 13 in the present embodiment, as shown in FIGS. 5 and 6, has two reinforcing ribs 13*i* and 13*j* for increasing the strength of the developing frame 13 provided on the back 13*g* of the joined surface on which the welding rib 13*c* is provided. As shown in FIG. 5, the reinforcing ribs 13*i* and 13*j* form lengthwise ridges protruding in a direction opposite to the direction of protrusion of the welding rib 13*c* substantially perpendicularly to the back 13*g* of the joined surface on which the welding rib 13*c* is provided. The reinforcing ribs 13*i* and 13*j* form straight lines along the welding rib 13*c* and are disposed parallel to each other.

On the other hand, as shown in FIG. 8, in the developer container 14, concave welding grooves 14*c* and 14*d* are formed at locations opposed to the welding ribs 13*c* and 13*d*, respectively, of the developing frame 13. The two welding grooves 14*c* and 14*d* form straight lines and are disposed parallel to each other along the lengthwise direction of the opening portion 14*b*. Also, positioning holes 14*e* and 14*f* fitted to the bosses 13*e* and 13*f* (see FIG. 7), respectively, of the developing frame 13 are formed in the developer container 14 on the lengthwisely opposite end portions of the welding groove 14*c* disposed on the upper side.

As shown in FIG. 6, the joined portion of the developer container 14 and the joined portion of the developing frame 13 are made to face each other and the bosses 13*e* and 13*f* are fitted into the positioning holes 14*e* and 14*f*, respectively, to thereby position the developer container 14 and the developing frame 13 relative to each other. Thereafter, the developing frame 13 is urged toward the developer container 14 with the developer container 14 fixed to a stand, not shown, and ultrasonic vibration is applied while the backs 13*g* and 13*h* of the surfaces on which the welding ribs 13*c* and 13*d* of the developing frame 13 are provided and the backs of the surfaces on which the welding grooves 14*c* and 14*d* of the developer container 14 are provided are pressed. Thereupon, the welding ribs 13*c* and 13*d* are melted by the ultrasonic vibration and welded to the bottoms of the concave welding grooves 14*c* and 14*d*, whereby the developing frame 13 and the developer container 14 are coupled integrally with each other.

In the present embodiment, the welding rib 13*c* is disposed between the two reinforcing ribs 13*i* and 13*j* provided on the developing frame 13 as viewed from the direction intersecting with the joined surface on which the welding rib 13*c* is provided and the back 13*g* thereof and therefore, the deformation of the developing frame 13 during ultrasonic welding can be made little. Thereby, the dimensional unevenness of each portion of the developing frame 13 after welding can be made small. For example, as shown in FIG. 5, the unevenness of the positional accuracy of the arm portion 13*k* and coupling hole 131 of the developing frame 13 which are the coupling portion between the developing unit D and the cleaning unit C and the positional unevenness of such portions as the aforedescribed electrodes 20 and 21 for detecting the remaining amount of toner of which high positional accuracy is required can be made small and therefore, the unevenness of the quality of image and any reduction in the toner amount detection accuracy can be prevented.

While in the present embodiment, two reinforcing ribs 13*i* and 13*j* are provided, the number of the reinforcing ribs is not limited two, but may be more than two. Again in this case, the welding rib 13*c* is disposed so as to be located between the reinforcing ribs 13*i* and 13*j* adjacent to each other.

Embodiment 2

A second embodiment of the present invention will now be described with reference to FIGS. 9 and 10.

The schematic constructions of the main body of the image forming apparatus A and the process cartridge B are similar to those in the first embodiment and therefore, in the present embodiment, only different portions will be described and the other portions need not be described. In the second embodiment, in order to distinguish from the developing frame 13 and the developer container 14 in the first embodiment, the developing frame is designated by the reference numeral 25 and the developer container is designated by the reference numeral 26.

Figure 9:
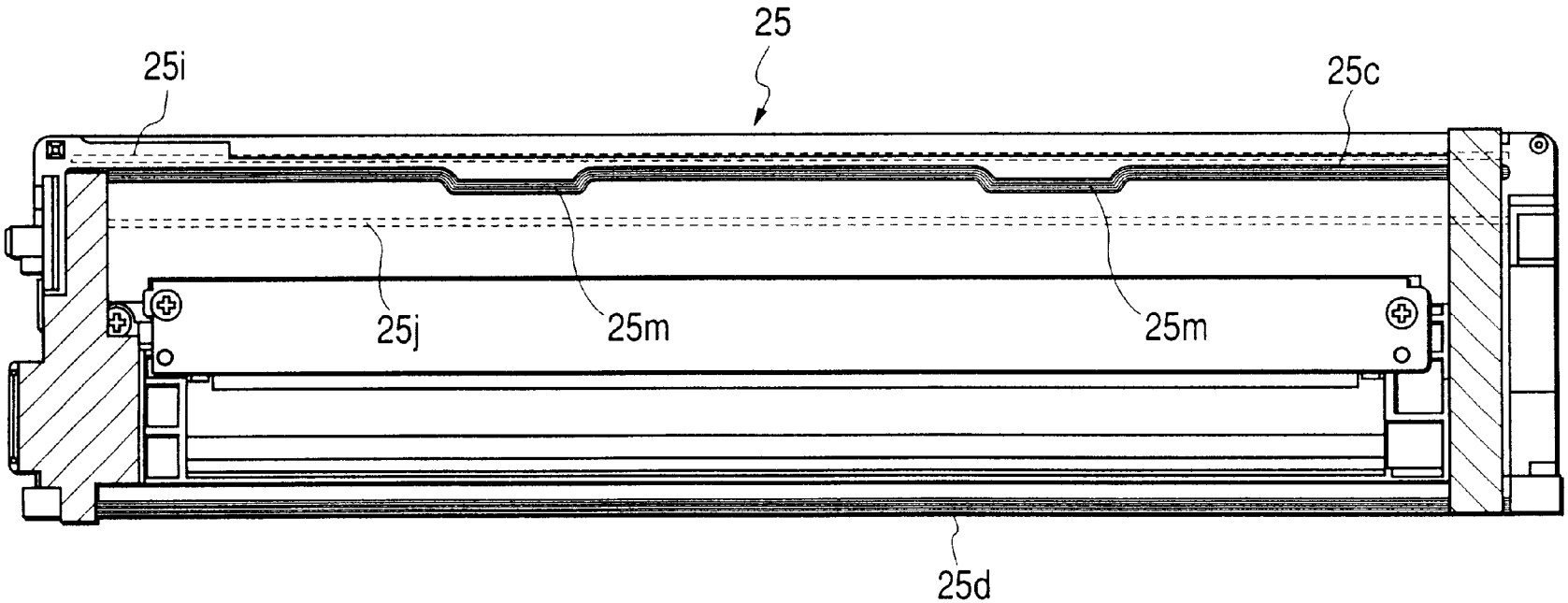
FIG. 9 is a front view showing a developing frame in a second embodiment of the present invention as it is seen from a developer container side.
Figure 10:
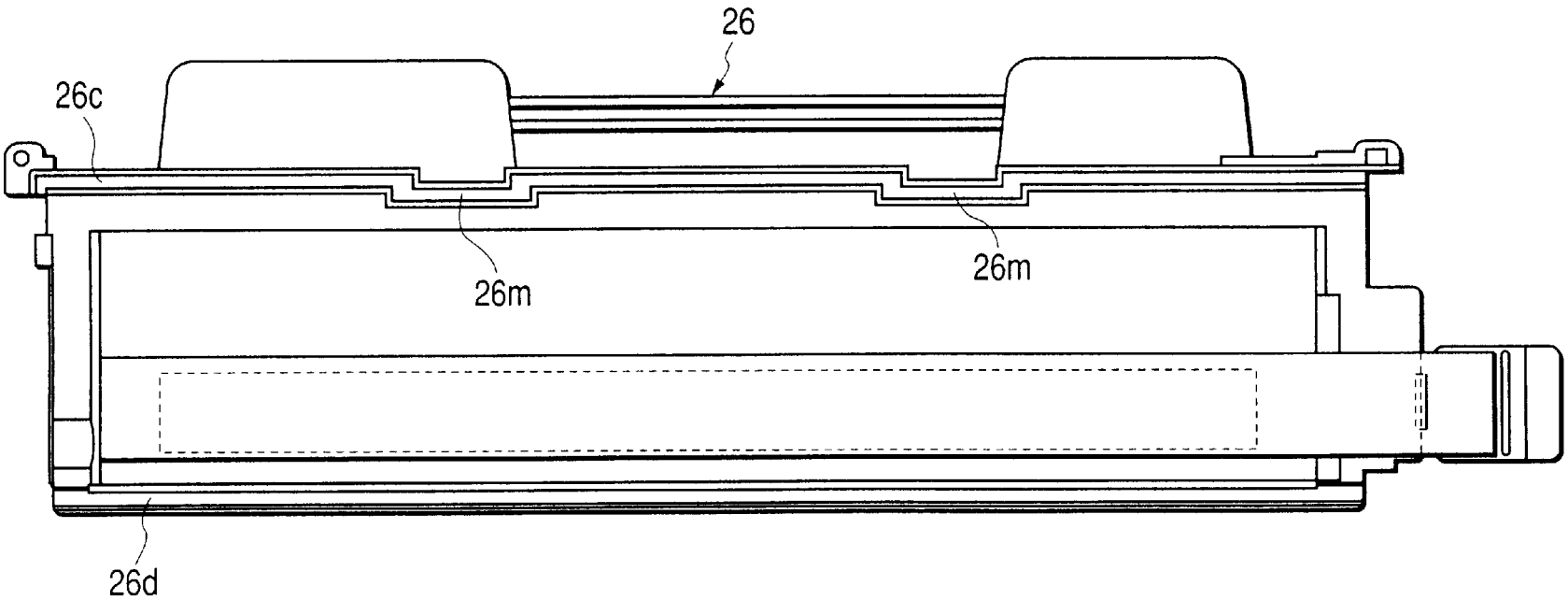
FIG. 10 is a front view showing the developer container in the second embodiment of the present invention as it is seen from the developing frame side.

FIG. 9 is a view of the developing frame 25 as it is seen from the developer container 26 side, and FIG. 10 is a view of the developer container 26 as it is seen from the developing frame 25 side.

As in the first embodiment, a welding rib 25*c* and a welding rib 25*d* are provided on the upper end side and the lower end side, respectively, of the joined surface of the developing frame 25 with the developer container 26. Also, two reinforcing ribs 25*i* and 25*j* (indicated by broken lines in FIG. 9) are provided on the back side of the developing frame 25 so as to reduce the deformation of the frame during welding. The two reinforcing ribs 25*i* and 25*j* form long straight lines parallel to the lengthwise direction (the left to right direction in FIG. 9) of the developing frame 25, and are disposed so as to be parallel to each other keeping an appropriate interval therebetween. The reinforcing ribs 25*i* and 25*j* are provided so as to protrude substantially perpendicularly to the back of the joined surface on which the welding rib 25*c* is provided and in a direction opposite to the direction of protrusion of the welding rib 25*c*.

In the second embodiment, the welding rib 25*c*, unlike the welding rib 13*c* in the first embodiment, is not a straight line, but is provided with U-shaped portions 25*m* halfway of it. Accordingly, as compared with the case where the welding rib is formed into the shape of a straight line, the welding rib 25*c* has a width in the widthwise direction thereof (the vertical direction in FIG. 9), but is disposed so as to be located between the reinforcing ribs 25*i* and 25*j*. In the present embodiment, the U-shaped portions 25*m* are provided at locations substantially trisecting the full length of the welding rib 25*c*.

Also, as shown in FIG. 10, the welding groove 26*c* of the developer container 26 is also provided with U-shaped portions 26*m* correspondingly to the shape of the welding rib 25*c*. The developing frame 25 and the developer container 26 are welded and coupled together by a method similar to that in the first embodiment. Since the shape of the welding rib 25*c* is formed so as to include the U-shaped portions, the welded area increases more than when the welding rib is formed into a straight line, and the welding strength of the developing frame 25 and the developer container 26 can be improved. While in the present embodiment, the welding rib 25*c* is of a shape having the U-shaped portions 26m, the present invention is not restricted to this shape, but the welding rib may be formed, for example, into a wavy shape, or may be formed so as to be provided with a plurality of parallel welding ribs.

As described above, in the present embodiment, the welding rib 25*c* is made into a shape other than a straight-line shape formed by linking the starting point and the end of the welding rib 25*c* together, whereby the welded area of the developing frame 25 and the developer container 26 is increased, and the welding strength per unit area can be improved.

While in the second embodiment, two reinforcing ribs 25*i* and 25*j* are provided, the number of the reinforcing ribs is not limited to two, but may be more than two. Again in this case, the welding ribs 25*m* are disposed so as to be located between the reinforcing ribs 25*i* and 25*j* adjacent to each other as viewed from a direction intersecting with the joined surface on which the welding ribs 25*m* are provided and the back thereof.

Embodiment 3

A third embodiment of the present invention will now be described with reference to FIGS. 11 and 12.

The schematic constructions of the main body of the image forming apparatus A and the process cartridge B are similar to those in the first embodiment and therefore, in the present embodiment, only different portions will be described and the other portions need not be described. In the third embodiment, in order to distinguish from the developing frames in the first and second embodiments, the developing frame is designated by the reference numeral 27.

Figure 11:
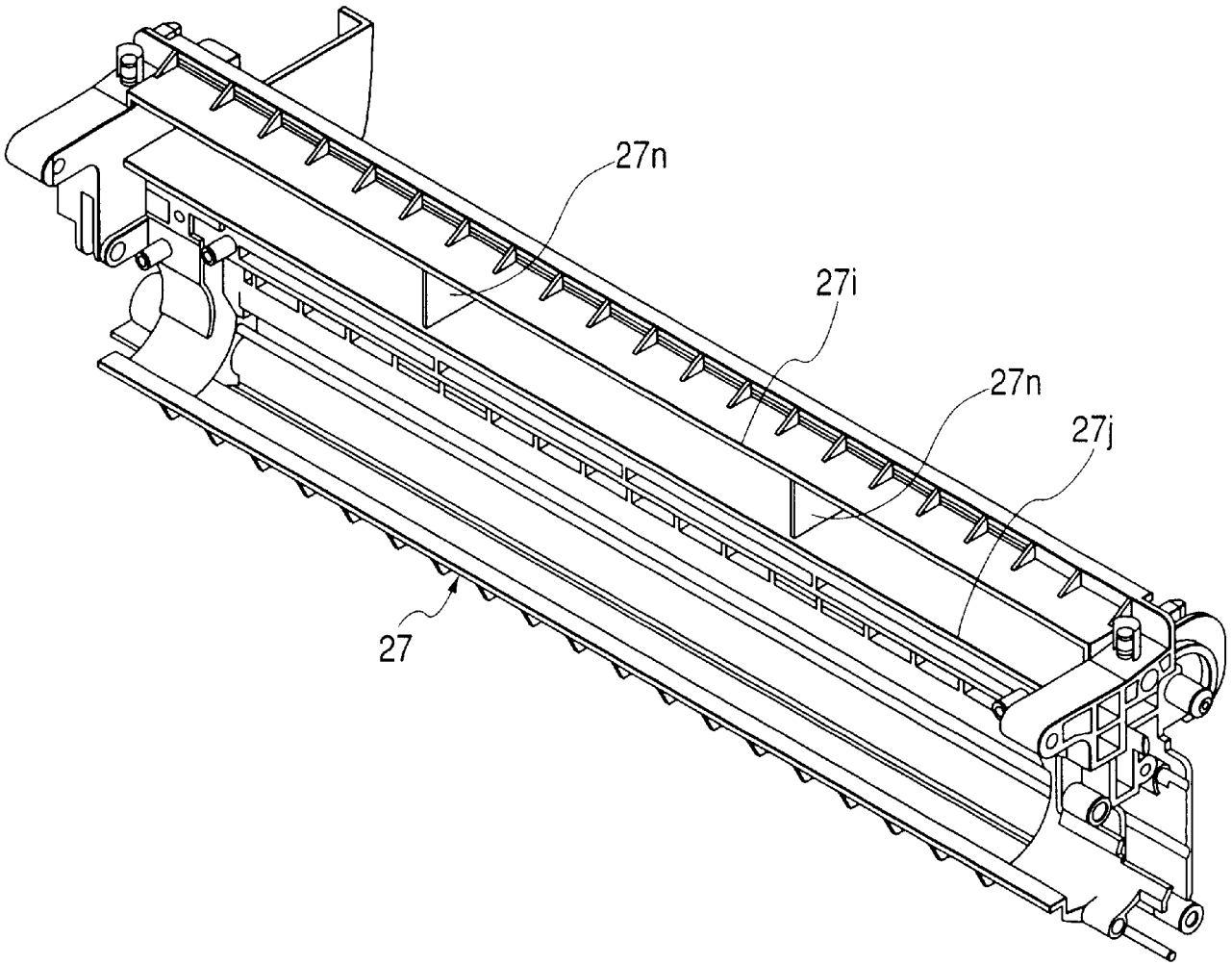
FIG. 11 is a perspective view of a developing frame in a third embodiment of the present invention.
Figure 12:
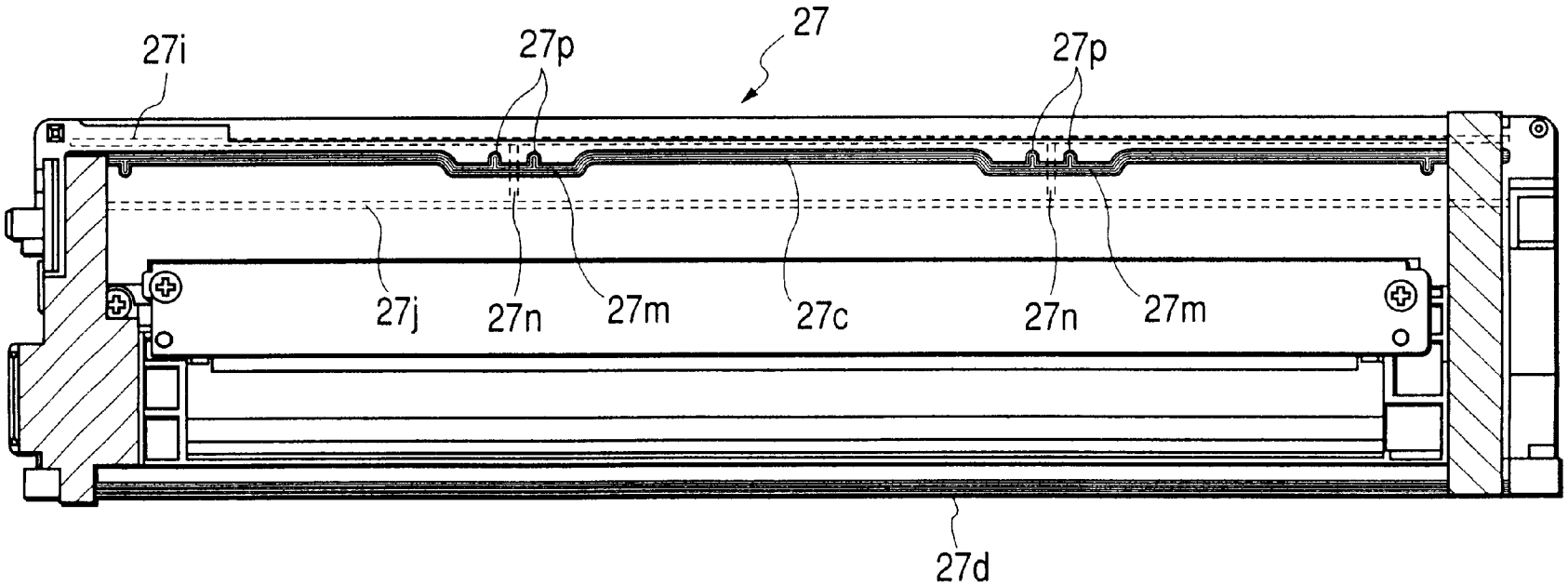
FIG. 12 is a front view showing the developing frame in the third embodiment of the present invention as it is seen from a developer container side.

FIG. 11 is a perspective view of the developing frame 27, and FIG. 12 is a view of the developing frame 27 as it is seen from the developer container side.

As in the first embodiment, a welding rib 27*c* and a welding rib 27*d* are provided on the upper end side and the lower end side, respectively, of the joined surface of the developing frame 27 with the developer container, as shown in FIG. 12. Also, two reinforcing ribs 27*i* and 27*j* (indicated by broken lines in FIG. 12) are provided on the back of the joined surface on which the welding ribs 27*c* and 27*d* of the developing frame 27 are provided so as to reduce the deformation of the frame during welding. The two reinforcing ribs 27*i* and 27*j* form long straight lines parallel to the lengthwise direction (the left to right direction in FIG. 12) of the developing frame 27, and are disposed so as to be parallel to each other keeping an appropriate interval therebetween. As shown in FIG. 11, the reinforcing ribs 27*i* and 27*j* are provided so as to protrude substantially perpendicularly to the back of the surface on which the welding rib 27*c* is provided and in a direction opposite to the direction of protrusion of the welding rib 27*c*.

Further, in the third embodiment, vertical reinforcing ribs 27*n* as second reinforcing ribs disposed in a direction orthogonal to the reinforcing ribs 27*i* and 27*j* are provided between the reinforcing rib 27*i* and the reinforcing rib 27*j*. The vertical reinforcing ribs 27*n* connect between the reinforcing ribs 27*i* and 27*j*, and in the present embodiment, as shown in FIGS. 11 and 12, two such ribs are provided at locations substantially trisecting the reinforcing ribs 27*i*, 27*j* in the lengthwise direction thereof. Accordingly, the welding rib 27*c*, as shown in FIG. 12, is designed to be astride the vertical reinforcing ribs 27*n* which are the second reinforcing ribs. The vertical reinforcing ribs 27*n* have their upper and lower ends continuously molded integrally with the reinforcing rib 27*i* and the reinforcing rib 27*j*, and by the vertical reinforcing ribs 27*n* being provided as in the present embodiment, the strength of the frame can be further improved. The vertical reinforcing ribs 27*n* need not always be disposed so as to be orthogonal to the reinforcing ribs 27*i* and 27*j*, but can be disposed in any direction intersecting with the reinforcing ribs 27*i* and 27*j*.

When use is made of the developing frame 27 provided with the welding rib 27*c* in the present embodiment, use is made of a developer container provided with a welding groove of a shape corresponding to the welding rib 27*c*. The developing frame 27 and the developer container are welded and coupled together by a method similar to that in the first embodiment. At this time, in the portions wherein the vertical reinforcing ribs 27*n* are provided, it is impossible to apply ultrasonic vibration during welding while directly pressing the back of the welding rib 27*c* and therefore, the welding strength in the vicinity thereof becomes liable to decrease.

So, in the third embodiment, the welding rib 27*c* is provided with not only U-shaped portions 27*m*, but also reinforcing welding ribs 27*p* halfway thereof. In the present embodiment, at locations corresponding to the vertical reinforcing ribs 27*n*, i.e., as viewed from the direction intersecting with the joined surface on which the welding ribs 27*m* ate provided and the back thereof, two reinforcing welding ribs 27*p* are provided on both sides of each vertical reinforcing rib 27*n*. Each reinforcing welding rib 27*p* is disposed in the shape of a straight line in the widthwise direction, and one end thereof is continuous from the U-shaped portion 27*m*. The welding rib 27*c*, as compared with the case where it is formed in the shape of a straight line, has a width in the widthwise direction (the vertical direction in FIG. 12). Again in this case, however, the welding ribs 27*m* are disposed so as to be located between the reinforcing ribs 27*i* and 27*j* as viewed from the direction intersecting with the joined surface on which the welding ribs 27*m* are provided and the back thereof.

As described above, the reinforcing welding ribs 27*p* are provided at the locations corresponding to the vertical reinforcing ribs 27*n*, whereby the welded area can be increased to thereby secure the welding strength. That is, even when the number of the vertical reinforcing ribs 27*n* provided on the developing frame 27 is increased, the deformation of the frame during welding can be further reduced without the welding strength being lowered.

While in the present embodiment, the welding rib 27*c* is of a shape having the U-shaped portions 27*m*, the present invention is not restricted to this shape, but for example, a wavy rib or a plurality of parallel welding ribs may be provided with reinforcing welding ribs. Also, the number of the reinforcing ribs is not limited to two, but may be more than two. Again in this case, the welding rib is disposed so as to be located between the reinforcing ribs adjacent to each other.

While in each of the above-described embodiments, there has been shown a developing device in which the developing means 10, etc. are constructed as an integral developing unit, the present invention is not restricted thereto, but can also be used in a process cartridge B provided with the developing device, and an electrophotographic image forming apparatus or the like having such a developing device.

Also, while in the above-described first, second and third embodiments, description has been made of an example in which the developing frame and the developer container are ultrasonically welded together, the present invention is the technique of welding two frames constituting the process cartridge together, and is not restricted to the welding of the developing frame and the developer container, but is of course also applicable to a case where other frames are welded and fixed to each other. For example, when the developer container 14 or the removed toner reservoir 9*b* comprises two members such as a lid portion and a container portion, the present invention can also be applied to the ultrasonic welding of the lid portion and the container portion. The present invention is also applicable to an electrophotographic image forming apparatus having an installation type developing device.

As described above, according to the present invention, in a developing device, a process cartridge and an electrophotographic image forming apparatus constructed with a developing frame and a developer container ultrasonically welded together, a welding rib provided on the developer frame is disposed between the reinforcing ribs of the developing frame and therefore, the deformation of the frame during the welding can be made little and the positional accuracy of each portion of the frame after welded can be improved.

Also, the welding rib has bent portions halfway in the lengthwise direction, thereof, whereby the welding strength can be improved and yet the deformation of the frame can be reduced to a small level.

Further, even when the number of the reinforcing ribs of the frame is increased, there can be provided a construction which secures the welding strength and suffers little from the deformation of the frame during the welding.

While the invention has been described with reference to the structure disclosed herein, it is not confined to the details set forth and this application is intended to cover such modifications or changes as may come within the purposes of the improvements or the scope of the following claims.

What is claimed is:

1. A developing device detachably mountable to a main body of an electrophotographic image forming apparatus and for developing an electrostatic latent image formed on an electrophotographic photosensitive member, said developing device comprising:

developing means for developing the electrostatic latent image formed on the electrophotographic photosensitive member;

a developer container for containing therein a developer to be used to effect a development of the electrostatic latent image by said developing means;

a developing frame for supporting said developing means;

a plurality of reinforcing members provided along a lengthwise direction of said developing frame with spacing between them in a direction intersecting the lengthwise direction to increase the strength of said developing frame; and a welding rib with which said developer container and said developing frame are connected together by ultrasonic welding, said welding rib being provided on a joined surface opposite from a surface on which said plurality of reinforcing members are provided, and said welding rib being provided between said plurality of reinforcing members.

2. A developing device according to claim 1, wherein said welding rib has a bent portion halfway in the lengthwise direction thereof.

3. A developing device according to claim 1, wherein said welding rib has a U-shaped bent portion halfway in the lengthwise direction thereof.

4. A developing device according to claim 3, wherein said U-shaped bent portion is provided in each of positions substantially trisecting an overall length of said welding rib.

5. A developing device according to any one of claims 1, 2, 3 and 4, further comprising an intersecting reinforcing member provided in a direction intersecting with said plurality of reinforcing members of said developing frame to increase the strength of said developing frame, wherein said welding rib has a portion astride of and bent in a vicinity of said intersecting reinforcing member.

6. A developing device according to any one of claims 1, 2, 3 and 4, further comprising a reinforcing welding rib provided on the same surface as the surface, on which said welding rib is provided, of said developing frame to reinforce a connection of said developer container and said developing frame by the ultrasonic welding.

7. A developing device according to claim 6, wherein said reinforcing welding rib is disposed in a direction orthogonal to said welding rib.

8. A developing device according to claim 6, wherein said reinforcing welding rib is disposed on each of a left side and a right side of an intersecting reinforcing member as viewed from the direction intersecting with said joined surface.

9. A process cartridge detachably mountable to a main body of an electrophotographic image forming apparatus, said process cartridge comprising:

an electrophotographic photosensitive member;

developing means for developing an electrostatic latent image formed on said electrophotographic photosensitive member;

a developer container for containing therein a developer to be used to effect a development of the electrostatic latent image by said developing means;

a developing frame for supporting said developing means;

a plurality of reinforcing members provided along a lengthwise direction of said developing frame with spacing between them in a direction intersecting the lengthwise direction to increase the strength of said developing frame; and a welding rib with which said developer container and said developing frame are connected together by ultrasonic welding, said welding rib being provided on a joined surface opposite from a surface on which said plurality of reinforcing members are provided, and said welding rib being provided between said plurality of reinforcing members.

10. A process cartridge according to claim 9, wherein said welding rib has a bent portion halfway in the lengthwise direction thereof.

11. A process cartridge according to claim 9, wherein said welding rib has a U-shaped bent portion halfway in the lengthwise direction thereof.

12. A process cartridge according to claim 11, wherein said U-shaped bent portion is provided in each of positions substantially trisecting an overall length of said welding rib.

13. A process cartridge according to any one of claims 9, 10, 11 and 12, further comprising an intersecting reinforcing member provided in a direction intersecting with said plurality of reinforcing members of said developing frame to increase the strength of said developing frame, wherein said welding rib has a portion astride of and bent in a vicinity of said intersecting reinforcing member.

14. A process cartridge according to any one of claims 9, 10, 11 and 12, further comprising a reinforcing welding rib provided on the same surface as the surface, on which said welding rib is provided, of said developing frame to reinforce a connection of said developer container and said developing frame by the ultrasonic welding.

15. A process cartridge according to claim 14, wherein said reinforcing welding rib is disposed in a direction orthogonal to said welding rib.

16. A process cartridge according to claim 14, wherein said reinforcing welding rib is disposed on each of a left side and a right side of an intersecting reinforcing member as viewed from the direction intersecting with said joined surface.

17. An electrophotographic image forming apparatus for forming an image on a recording medium, comprising:

an electrophotographic photosensitive member;

an electrostatic latent image forming means for forming an electrostatic latent image on said electrophotographic photosensitive member; and a developing device comprising developing means for developing the electrostatic latent image, a developer container for containing therein a developer to be used to effect a development of the electrostatic latent image by said developing means, a developing frame for supporting said developing means, a plurality of reinforcing members provided along a lengthwise direction of said developing frame with spacing between them in a direction intersecting the lengthwise direction to increase the strength of said developing frame, and a welding rib with which said developer container and said developing frame are connected together by ultrasonic welding, said welding rib being provided on a joined surface opposite from a surface, on which said plurality of reinforcing members are provided, and said welding rib being provided between said plurality of reinforcing members.

18. An electrophotographic image forming apparatus to which a process cartridge is detachably mountable for forming an image on a recording medium, said electrophotographic image forming apparatus comprising:

mounting means for detachably mounting a process cartridge, the process cartridge comprising an electrophotographic photosensitive member and a developing device, the developing device comprising developing means for developing an electrostatic latent image formed on the electrophotographic photosensitive member, a developer container for containing therein a developer to be used to effect a development of the electrostatic latent image by the developing means, a developing frame for supporting the developing means, a plurality of reinforcing members provided along a lengthwise direction of the developing frame with spacing between them in a direction intersecting the lengthwise direction to increase the strength of the developing frame, and a welding rib with which the developer container and the developing frame are connected together by ultrasonic welding, the welding rib being provided on a joined surface opposite from a surface on which the plurality of reinforcing members are provided, and the welding rib being provided between the plurality of reinforcing members;

electrostatic latent image forming means for forming the electrostatic latent image on the electrophotographic photosensitive member; and transporting means for transporting the recording medium.

* * * * *

UNITED STATES PATENT AND TRADEMARK OFFICE

CERTIFICATE OF CORRECTION

PATENT NO. : 6,625,413 B2
DATED : September 23, 2003
INVENTOR(S) : Toru Oguma et al.

It is certified that error appears in the above-identified patent and that said Letters Patent is hereby corrected as shown below:

Title page,
Item [57], ABSTRACT,
Line 13, “by-ultrasonic” should read -- by ultrasonic --.

Column 6,
Line 33, “in.” should read -- in --.
Line 40, “first.” should read -- first --.

Column 12,
Line 12, “ate” should read -- are --.

Signed and Sealed this

Twenty-second Day of June, 2004

JON W. DUDAS
*Acting Director of the United States Patent and Trademark Office*